US010119300B2

(12) United States Patent
Yeh et al.

(10) Patent No.: US 10,119,300 B2
(45) Date of Patent: Nov. 6, 2018

(54) LOCK

(71) Applicant: ASUSTeK COMPUTER INC., Taipei (TW)

(72) Inventors: Chin-Hsin Yeh, Taipei (TW); Chien-Chin Wang, Taipei (TW); Chiang-Sheng Tseng, Taipei (TW); Te-Chuan Kuo, Taipei (TW)

(73) Assignee: ASUSTek COMPUTER INC., Taipei (TW)

( * ) Notice: Subject to any disclaimer, the term of this patent is extended or adjusted under 35 U.S.C. 154(b) by 0 days.

(21) Appl. No.: 15/152,578

(22) Filed: May 12, 2016

(65) Prior Publication Data

US 2016/0340932 A1 Nov. 24, 2016

(30) Foreign Application Priority Data

May 19, 2015 (TW) ..... 104207691 U
Jul. 31, 2015 (TW) ..... 104125011 A

(51) Int. Cl.
*E05B 45/06* (2006.01)
*E05B 49/00* (2006.01)

(52) U.S. Cl.
CPC ..... *E05B 45/06* (2013.01); *E05B 49/004* (2013.01); *E05B 2045/069* (2013.01); *E05B 2045/0635* (2013.01)

(58) Field of Classification Search
CPC ..... E05B 45/00; E05B 45/06; E05B 45/10; E05B 2045/0635; E05B 2045/064; E05B 2045/065; E05B 2045/067; E05B 49/00; E05B 49/002; E05B 49/004; E05B 2045/069
See application file for complete search history.

(56) References Cited

U.S. PATENT DOCUMENTS 2,057,301 A * 10/1936 Golokow ..... E05B 45/10 200/43.08
4,328,692 A * 5/1982 Dice ..... E05B 45/10 70/421
4,656,851 A * 4/1987 Leek ..... E05B 45/10 340/542
4,712,398 A * 12/1987 Clarkson ..... E05B 47/063 361/172

(Continued)

FOREIGN PATENT DOCUMENTS

CN 201588458 9/2010
CN 202831856 3/2013

(Continued)

OTHER PUBLICATIONS

"Office Action of China Counterpart Application," dated Nov. 23, 2017, p. 1-p. 6.

*Primary Examiner* — Christopher J Boswell
(74) *Attorney, Agent, or Firm* — JCIPRNET

(57) ABSTRACT

A lock including a lock cylinder, at least one sensing module and a processing unit is provided. The lock cylinder is adapted for allowing a unlocking unit to insert therein along an inserting direction. The at least one sensing module detects a movement of the lock cylinder. The processing unit electrically connected to the at least one sensing module. The sensing module generates a sensing signal to the processing unit according to the movement of the lock cylinder.

10 Claims, 4 Drawing Sheets

(56) References Cited

U.S. PATENT DOCUMENTS

| | | | | | |
|---|---|---|---|---|---|
| 5,208,579 | A * | 5/1993 | Tseng | E05B 45/06 | 200/61.66 |
| 5,691,711 | A * | 11/1997 | Jorgensen | E05B 349/002 | 340/5.67 |
| 9,394,723 | B1 * | 7/2016 | Roth | E05B 47/063 | |

FOREIGN PATENT DOCUMENTS

| | | |
|---|---|---|
| CN | 202866444 | 4/2013 |
| CN | 103216150 | 7/2013 |
| TW | 170298 | 10/1991 |

* cited by examiner

LOCK

CROSS-REFERENCE TO RELATED APPLICATION

This application claims the priority benefit of Taiwan application serial No. 104207691, filed on May 19, 2015 and Taiwan application serial No. 104125011, filed on Jul. 31, 2015. The entirety of each of the above-mentioned patent applications are hereby incorporated by references herein and made a part of specification.

BACKGROUND OF THE INVENTION

Field of the Invention

The invention relates to a lock and, more specifically, to a lock with a sensing function.

Description of the Related Art

Generally, a common lock is unlocked by using an unlocking unit. The unlocking unit has a plurality of recesses with different depths that correspond to columnar or beaded elastic components of the lock, respectively. When the unlocking unit inserts into the lock cylinder, the columnar or beaded elastic components match the corresponding recesses at an unlocking position, the lock can be unlocked by rotating the unlocking unit inside the lock cylinder. However, the lock may also be unlocked via other tools, such as a slender rod, a hook and a master unlocking unit. Then, the lock is no longer secure enough.

BRIEF SUMMARY OF THE INVENTION

According to a first aspect of the present disclosure, a lock comprises: a lock cylinder adapted for allowing an unlocking unit to insert therein along an inserting direction; at least one sensing module for detecting a movement of the lock cylinder; and a processing unit electrically connected to the at least one sensing module, wherein the sensing module generates a sensing signal to the processing unit according to the movement of the lock cylinder.

In sum, in embodiments, when it is determined that the unlocking operation does not meet the preset condition, the alarm unit is enabled to send out the alarm signal via the gateway, so the wrong unlocking operation is warned.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
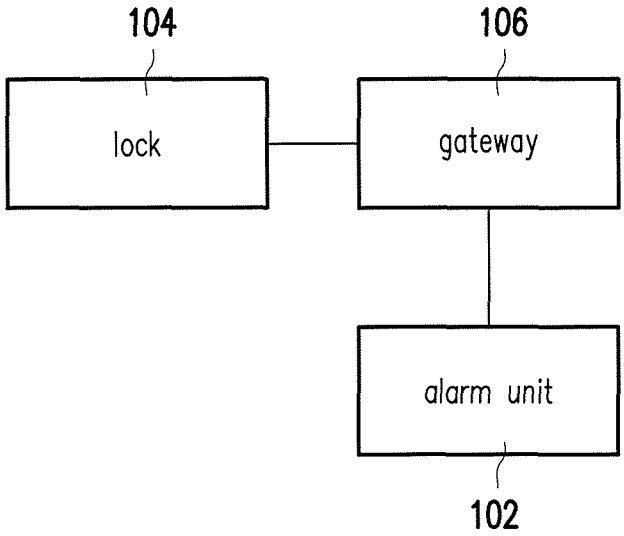
FIG. 1 is a schematic diagram showing an locking system in an embodiment.

FIG. 1 is a schematic diagram showing a locking system in an embodiment. Referring to FIG. 1, a locking system includes an alarm unit 102, a lock 104 and a gateway 106. The lock 104 is connected with the alarm unit 102 and the gateway 106. The lock is unlocked when it determines an unlocking operation meets a preset condition. Conversely, when the unlocking operation does not meet the preset condition, the lock 104 outputs an alarm signal via the gateway 106 to warn an intruder. In an embodiment, the alarm unit 102 includes, but not limited to, an alarm bell or a light-emitting element. The alarm signal includes, but not limited to, a sound alarm or a light alarm. In an embodiment, when the unlocking operation does not meet the preset condition, the lock provides a notification message to a remote communication device (such as a smart phone or a tablet PC) via the gateway 106 to inform the user that an improper unlocking operation is performed on the lock 104. In an embodiment, the gateway 106 provides the notification message to the remote communication device via a network server (such as a cloud server). In another embodiment, the gateway 106 provides the notification message to the remote communication device directly via a wireless communication. In an embodiment, the lock 104 is unlocked by the remote communication device. In an embodiment, the lock 104 is adapted for manually setting an anti-theft mode (for example, the security mode is enabled or disabled) for more convenience.

Figure 2:
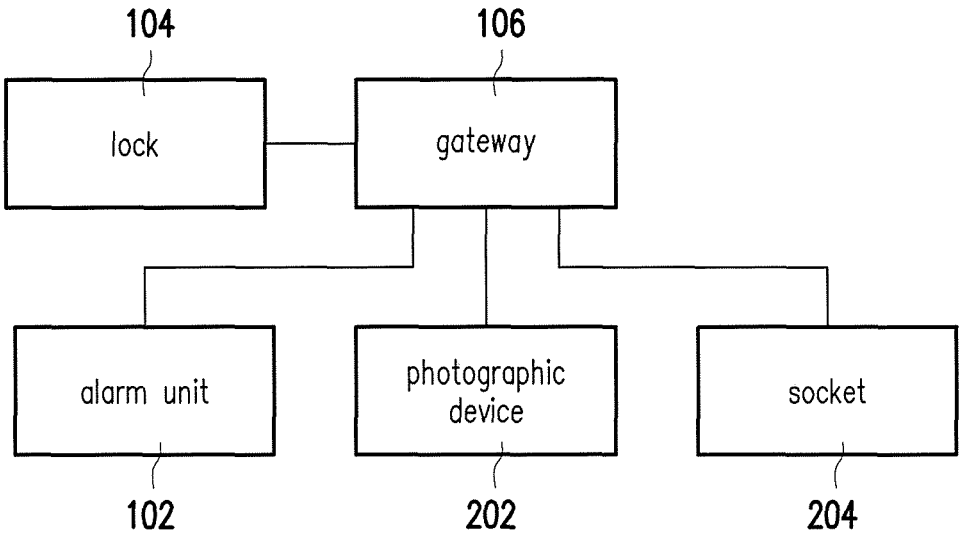
FIG. 2 is a schematic diagram showing a locking system in an embodiment.

In an embodiment, the alarm unit 102, the lock 104 drives other devices via the gateway 106. FIG. 2 is a schematic diagram showing an anti-theft device in an embodiment. Referring to FIG. 2, in the embodiment, the locking system further includes a photographic device 202 and a socket 204. The photographic device 202 and the socket 204 are connected with the gateway 106. When the lock 104 determines that the unlocking operation does not meet the preset condition, the lock 104 enables the photographic device 202 and the socket 204 via the gateway 106. In an embodiment, the photographic device 202 captures an image of the intruder as a record. The socket is connected to other electronic device such as a LED light-emitting device. The socket provides a power supply to the connected electronic device.

Figure 3A:
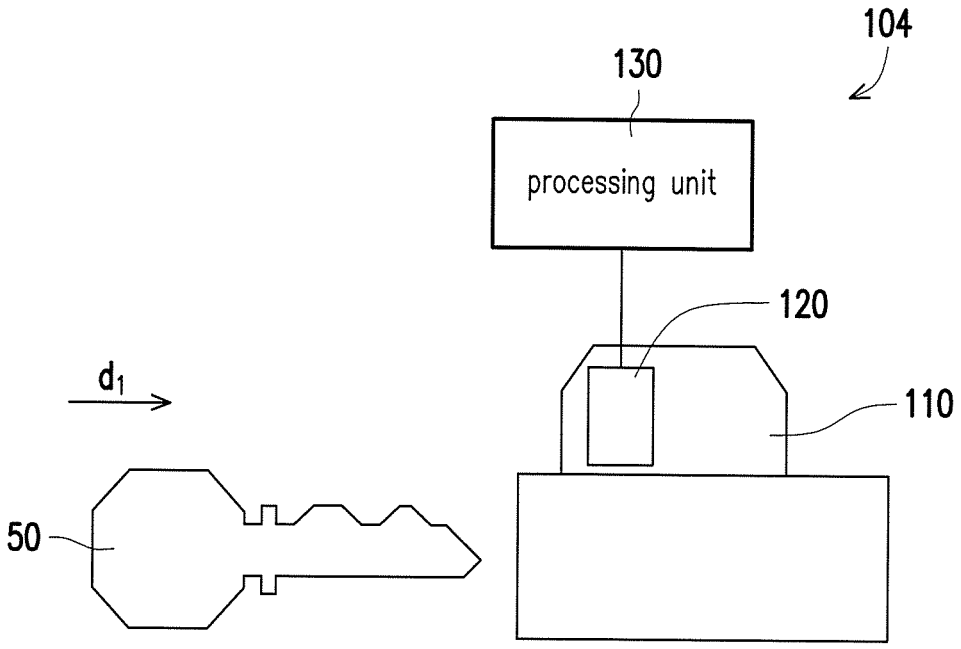
FIG. 3A is a schematic diagram showing a lock cylinder and an unlocking unit in an embodiment.

In an embodiment, the unlocking operation is to unlock the lock by the unlocking unit. FIG. 3A is a schematic diagram showing a lock cylinder and an unlocking unit in an embodiment. Referring to FIG. 3A, the lock 104 includes a lock cylinder 110, a sensing module 120 and a processing unit 130. The processing unit 130 is electrically connected to the sensing module 120. The lock cylinder 110 allows the unlocking unit 50 to be inserted therein along an inserting direction $d_1$. In an embodiment, the unlocking unit 50 is a key.

Figure 3B:
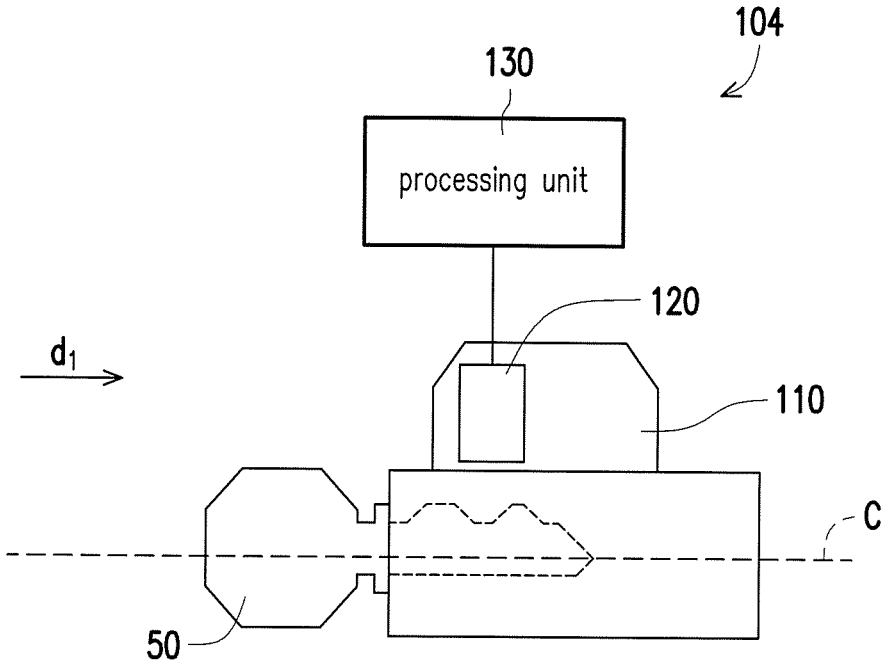
FIG. 3B is a schematic diagram showing an unlocking unit is located at a predetermined position of a lock cylinder according to the embodiment in FIG. 3A.

FIG. 3B is a schematic diagram showing that an unlocking unit is located at a predetermined position of a lock cylinder according to the embodiment in FIG. 3A. Referring to FIG. 3A and FIG. 3B, in the embodiment, the unlocking unit 50 is inserted into the lock cylinder 110 along the inserting direction $d_1$. The sensing module 120 detects a movement of the lock cylinder 110. In an embodiment, the sensing module 120 detects the movement of the lock cylinder 110 along a sensing direction perpendicular to the inserting direction $d_1$ and generates a sensing signal to the processing unit 130 according to the movement of the lock cylinder 110.

Figure 4:
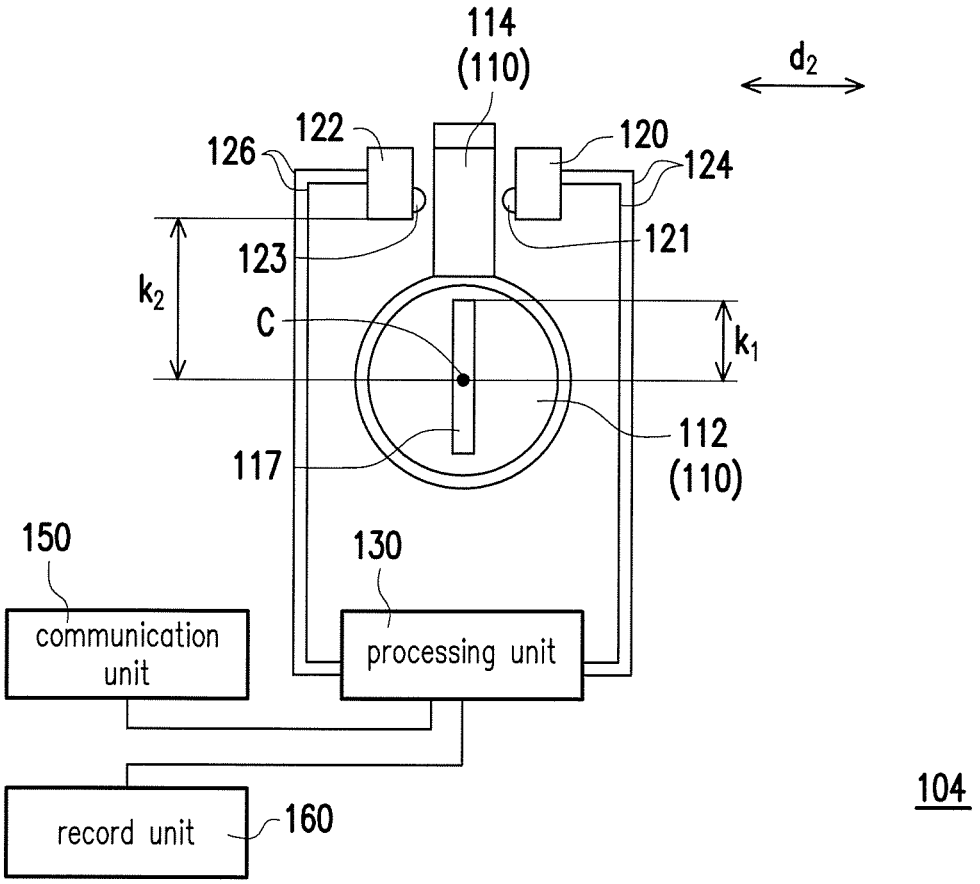
FIG. 4 is a schematic diagram showing a lock in an embodiment.

FIG. 4 is a schematic diagram showing a lock in an embodiment. Referring to FIG. 4, in the embodiment, the lock 104 includes two sensing modules 120,122 near the lock cylinder 110. The sensing modules 120,122 detect a movement of the lock cylinder 110 in a sensing direction $d_2$. When the lock cylinder 110 moves along the sensing direction $d_2$, the sensing modules 120,122 generate a sensing signal to the processing unit 130 according to the movement of the lock cylinder 110. The processing unit 130 determines whether the lock 104 is normally unlocked according to the sensing signal. In another embodiment, the number of a signal sensing module is one, which is not limited herein, the number of the sensing module is adjustable according to the rotation of the unlocking unit 50 inside the lock cylinder.

In an embodiment, when the lock 104 is unlocked by the unlocking unit 50, the elastic components (not shown) of the lock cylinder 110 are moved to each unlocking positions by the recesses of the unlocking unit 50. When the unlocking unit 50 rotates inside the lock 104, the movement of the lock cylinder 110 along the sensing direction $d_2$ is slight and is completed in a short time with a low frequency. Conversely, when the lock 104 is unlocked in an abnormal way by an improper unlock tool, each elastic components of the lock cylinder 110 has to be move to the correct unlocking position one by one during the unlocking operation. Therefore, the elastic components of the lock cylinder 110 are against by the improper unlocking tool for a long time and thus the sensing modules 120,122 generate multiple sensing signals to the processing unit 130. That is, the processing unit 130 determines whether the lock cylinder 110 is unlocked normally or not according to the duration and also the frequency of the sensing signals, which increase security levels.

Referring to FIG. 3B and FIG. 4, in the embodiment, when the unlocking unit 50 is inserted into the lock cylinder 110 at a predetermined position, the lock cylinder 110 is adapted for the unlocking unit 50 to rotate around an axis C. The axis C is perpendicular to the sensing direction $d_2$. The sensing modules 120,122 and the axis C have a distance $k_2$ therebetween. The lock cylinder 110 moves along the sensing direction $d_2$ when the lock cylinder 110 is rotated by the unlocking unit 50 from a non-predetermined position or rotated by other tools that inserted into the lock cylinder 110.

In the embodiment, the lock cylinder 110 includes a protruding part 114 and a cylinder part 112. The predetermined position is located within the cylinder part 112. The sensing modules 120,122 detect a movement of the protruding part 114 along the sensing direction $d_2$. When the unlocking unit 50 is inserted into the predetermined position, the cylinder part 112 is adapted to rotate relatively to the protruding part 114. Therefore, when the unlocking unit 50 at the predetermined position rotates the cylinder part 112, the protruding part 114 would not approximate to or contact the sensing modules 120,122 for a long time. Then, the processing unit 130 determines that the lock 104 is unlocked in success.

Referring to FIG. 3B and FIG. 4, in the embodiment, the cylinder part 112 includes an inserting hole 117 for inserting the unlocking unit. The unlocking unit 50 is inserted into the inserting hole 117 to the predetermined position. The distance $k_2$ between the sensing modules 120,122 and the axis C is larger than a maximum distance $k_1$ between the edge of the inserting hole 117 and the axis C. Therefore, when the lock cylinder 110 rotates around the axis C, a moment arm of the sensing modules 120,122 relative to the axis C is larger than that of the edge of the inserting hole 117 relative to the axis C. Therefore, the sensing modules 120,122 are capable of detecting a slight movement and rotation of the inserting hole 117. In this way, the sensitivity of the sensing modules 120,122 (which detect the motion of the lock cylinder 110) is improved. On the other hand, in the embodiment, the lock cylinder 110 is located between the sensing modules 120,122 along the sensing direction $d_2$. Therefore, the sensing modules 120,122 detect a total movement of the axis 110 along the sensing direction $d_2$.

Referring to FIG. 4, in the embodiment, the sensing module 120 includes a switch 121 and a connecting wire 124 that are electrically connected with each other. The sensing module 122 includes a switch 123 and a connecting wire 126 that are electrically connected with each other. The switches 121,123 are disposed at a side of the sensing modules 120,122 near the lock cylinder 110, respectively. When the lock cylinder 110 is pressed against the switch 121 or the switch 123 along the sensing direction $d_2$, the sensing module 120 or the sensing module 122 generates a sensing signal to the processing unit 130.

In the embodiment, the sensing module 120 and the sensing module 122 are microswitches. The switches 121, 123 enable the conduction of the connecting wires 124,126. In an embodiment, when the switch 121 moves along the sensing direction $d_2$, the connecting wire 124 is conducted. Then, a sensing signal is generated. In the embodiment, when the lock cylinder 110 moves along the sensing direction $d_2$, the switch 121 or the switch 123 is pressed to conduct the connecting wire 124 or the connecting wire 126 to provide the sensing signal. In an embodiment, the switches 121,123 bear a maximum force of 10 milligrame to avoid a determination of the sensing module 120 and the sensing module 122 in mistakes. In other embodiments, the switch is, but not limited to, a button, a plunger, a dome or a sheet, that moves along with a conductive end of the sensing modules to conduct the connecting wires to provide the sensing signal.

In the embodiment, the lock 104 further includes a communication unit 150 that coupled to the processing unit 130. When the sensing signal received by the processing unit 130 meets a preset condition, and the processing unit 130 determines that the unlocking operation does not meet the preset operation, the processing unit 130 provides an enable signal to the gateway 106 via the communication unit 150. Then, the gateway 106 enables the alarm unit 102 to provide an alarm signal. In an embodiment, the processing unit 130 utilizes the communication unit 150, such as a telephone call or a network, to provide a message about an abnormal unlocking operation of the lock 104. Therefore, the security of the lock 104 is improved. In an embodiment, when the unlocking operation does not meet the preset operation, the processing unit 130 informs the gateway 106 via the communication unit 150, and the gateway 106 provides a notification message to a remote communication device to warn the user that someone tries to unlock the lock abnormally.

In the embodiment, the processing unit 130 is a micro control unit. Commonly, an intruder uses improper tools to unlock the lock 104, it usually takes a long time to press against the lock cylinder 110 to make each elastic components (such as each columnar or beaded elastic component) to achieve each correct unlocking position. Therefore, when the duration of the sensing signals received by the processing unit 130 exceeds a preset time, for example, 10 seconds, the processing unit 130 provides a driving signal to enable the alarm unit 102 to output an alarm signal for warning. In the embodiment, when the processing unit 130 receives the sensing signal that meets a preset condition, for example, when the duration of the sensing signal is equal to or larger than the preset time, the processing unit 130 determines that the unlocking operation is abnormal. Then, an alarm enable signal is provided to the gateway 106 via the communication unit 150. The gateway 106 enables the alarm unit 102 to output the alarm signal.

In an embodiment, the preset condition is, but not limited to, a duration of the sensing signal meets a preset time, a frequency of the received sensing signals meets a preset condition or a value of the sensing signal meets a preset value. Generally, the sway frequency of the lock cylinder 110 in abnormal unlocking operation is higher than in normal unlocking operation. Therefore, when the frequency of the sensing signal received by the processing unit 130 is higher than a preset frequency, the processing unit 130 provides the enable signal to the gateway 106 via the communication unit 150. Then, the gateway 106 enables the alarm unit 102 to output an alarm signal.

In an embodiment, the lock 104 further includes a record unit 160 electrically connected to the processing unit 130. The record unit 160 records a time and a frequency of the sensing signal received by the processing unit 130. Therefore, an unlocking record and a status of the lock 104 are available for the user.

Figure 5:
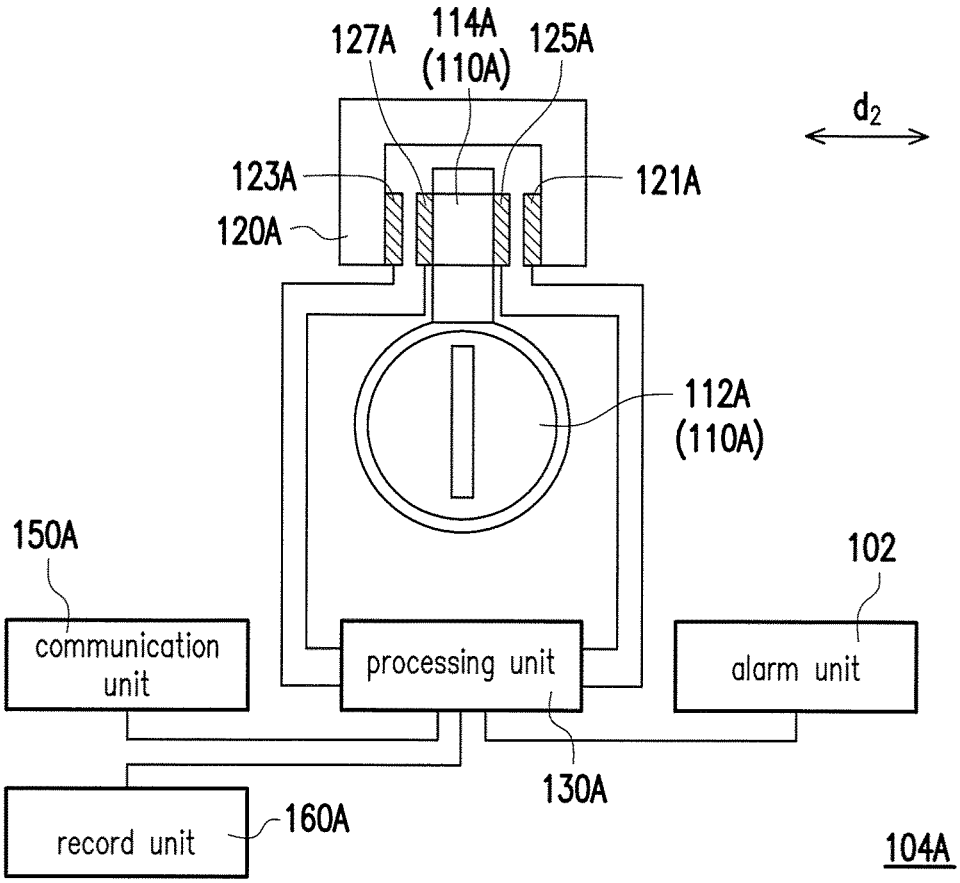
FIG. 5 is a schematic diagram showing a lock in an embodiment.

FIG. 5 is a schematic diagram showing a lock in an embodiment. Referring to FIG. 5, in the embodiment, the alarm unit 102 is connected with a processing unit 130A directly (as shown in FIG. 5, similarly, the processing unit 130 in FIG. 3A~FIG. 4 is connected with the alarm unit 102). When the sensing signal received by the processing unit 130A meets the preset condition, the processing unit 130 provides the driving signal to the alarm unit 102 to drive the alarm unit 102 to output an alarm signal, but not via the gateway 106 to enable the alarm unit 102 to output the alarm signal. In an embodiment, the sensing module 120A is U-shaped which is configured to surround the lock cylinder 110A. In an embodiment, the sensing module 120A further includes a sensing electrode 121A, a sensing electrode 123A, a lock cylinder electrode 125A and a lock cylinder electrode 127A. The lock cylinder electrode 125A and the lock cylinder electrode 127A are configured on the lock cylinder 110. The lock cylinder electrode 125A is located between the sensing electrode 121A and the lock cylinder 110, and the lock cylinder electrode 127A is located between the sensing electrode 123A and the lock cylinder 110. The lock cylinder electrodes 125A, 127A and the sensing electrodes 123A, 121A are electrically connected to the processing unit 130A. When the protruding part 114A of the lock cylinder 110A moves along with the movement of the cylinder part 112A, the sensing module 120A generates a sensing signal to the processing unit 130A when the lock cylinder electrode 125A contacts the sensing electrode 121A or when the lock cylinder electrode 127A contacts the sensing electrode 123A.

In the embodiment, the lock 104A determines whether the movement of the lock cylinder 110A along the sensing direction $d_2$ is generated according to the conduction between the lock cylinder electrode 125A and the sensing electrodes 121A, and between the lock cylinder electrode 127A and the sensing electrodes 123A, which is not limited herein. In an embodiment, the sensing signal relates to a capacitance value or other electrical parameters between the lock cylinder electrodes and the sensing electrodes. The processing unit determines whether the movement of the lock cylinder along the sensing direction is generated according to the capacitance value (or other electrical parameters). In an embodiment, the sensing module only includes the sensing electrodes, and the lock cylinder is electrically connected to the processing unit directly. The processing unit determines whether the movement of the lock cylinder along the sensing direction is generated according to the conduction between the lock cylinder and the sensing electrodes.

Figure 6:
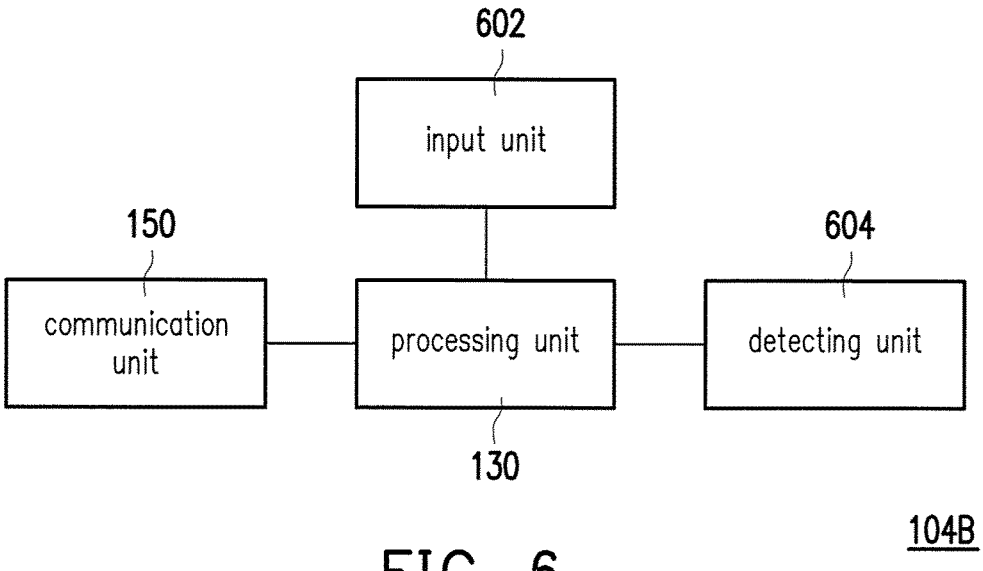
FIG. 6 is a diagram showing a lock in an embodiment.

In an embodiment, the unlocking operation is a code inputting operation. FIG. 6 is a diagram showing a combination lock in an embodiment. Referring to FIG. 6, in the embodiment, the lock 104B includes a processing unit 130, a communication unit 150, an input unit 602 and a detecting unit 604. The processing unit 130 is connected to the communication unit 150, the input unit 602 and the detecting unit 604. The processing unit 130 and the communication unit 150 have similar functions as those in the above embodiments. The input unit 602 is adapted for input codes. In an embodiment, the input unit 602 provides an operation interface for the user to input the code. In an embodiment, the input unit 602 includes a display displaying virtual buttons for the user to input the code. In another embodiment, the input unit 602 includes physical buttons for the user to input the code. The processing unit 130 determines whether the unlocking operation (the input code) meets the preset condition. When the unlocking operation does not meet the preset condition, the enable signal is provided to the gateway via the communication unit 150, and the gateway enables the alarm unit to output the alarm signal. In an embodiment, the maximum times for inputting a code (such as three times) is set by the processing unit 130. When the processing unit 130 determines that codes are input wrongly and consecutively more than three times (that is, the processing unit 130 determines that the unlocking operation does not meet the preset condition three times), then an enable signal is provided to the gateway via the communication unit 150 and the gateway enables the alarm unit to output the alarm signal.

In an embodiment, a group of subset preset codes is set by the processing unit 130. The processing unit 130 determines whether the code which is input by the user meets the subset preset codes (that is, the processing unit 130 determines whether the code inputting operation meets the subset preset condition). When the code inputting operation meets the subset preset condition, the processing unit 130 unlocks the lock 104B and provides a message for help to the gateway 106 via the communication unit 150. The gateway 106 sends the message for help to a remote communication device (such as a smart phone of a security guard or a telephone of a police station). In such a way, when a user is threatened by an intruder to unlock the lock 104B, the user could inform other people and ask for help secretly by inputting the subset preset code, without being noticed by the intruder. Thus, the user's personal safety is ensured.

In the embodiment, the detecting unit 604 detects whether the lock is unlocked. In an embodiment, the detecting unit 604 is, but not limited to a magnetic reed sensor. The processing unit 130 determines whether a door is unlocked before the unlocking operation is not performed according to a detecting result of the detecting unit 604. That is, the processing unit 130 determines whether the unlocking operation is performed. If the unlocking operation is not performed, the processing unit 130 then determines whether the door is unlocked. If the door is unlocked, the lock 104B is damaged by force. Then, the processing unit 130 provides an enable signal to the gateway 106 via the communication unit 150. The gateway 106 enables the alarm unit 102 to output an alarm signal and enables the photographic device 202 and the socket 204. A notification message is sent to a remote communication device via the gateway 106. Conversely, when the door is unlocked, the processing unit 130 then determines whether the unlocking operation is performed. When the processing unit 130 determines that the unlocking operation is performed, the processing unit 130 then determines whether the unlocking operation meets the preset condition. In an embodiment, the unlocking operation is a code inputting operation. The processing unit 130 determines whether the input code meets the preset condition. When the input code meets the preset condition, the lock 104B is unlocked. Conversely, when the input code does not meet the preset condition, the processing unit 130 then determines whether the code inputting operation meets the subset preset condition. When the code inputting operation meets the subset preset condition, the lock 104B is unlocked and a message for help is sent to the gateway 106. The gateway 106 sends the message for help to the remote communication device. Conversely, when the code inputting operation does not meet the subset preset condition, the processing unit 130 sends the enable signal to the gateway 106 via the communication unit 150. The alarm unit 102 is enabled to output the alarm signal, the photographic device 202 and the socket 204 are also enabled to send the notification message to the remote communication device via the gateway 106.

It should be noted that the sensing module, alarm unit, the processing unit, the communication unit, the record unit, the input unit and the detecting unit described above may be hardware components consisting of one or more circuits, but not limited thereto.

In sum, in the embodiments, when it is determined that the unlocking operation does not meet the preset condition, the alarm unit is enabled to output the alarm signal via the gateway, so that the intruder is frightened to stop unlocking the lock. Therefore, the anti-theft function of the lock is greatly improved. In the embodiments, whether the code inputting operation meets the subset preset condition is determined. When the code inputting operation meets the subset preset condition, the lock is unlocked, the message for help is sent to the remote communication device via the gateway. In such a way, when the user is hijacked by the intruder to unlock the lock, the user could inform others to ask for help secretly, without being noticed by the intruder. Therefore, the user's personal safety is ensured.

Although the invention includes been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. A lock comprising:

a lock cylinder adapted for allowing an unlocking unit to insert therein along an inserting direction;

at least one sensing module for detecting a movement of the lock cylinder;

a processing unit electrically connected to the at least one sensing module, wherein the sensing module generates a sensing signal to the processing unit according to the movement of the lock cylinder, and the processing unit determines whether the lock is normally unlocked according to the sensing signal;

an alarm unit connected to the processing unit; and a communication unit coupled to the processing unit, wherein when the sensing signal received by the processing unit meets a preset condition, the processing unit generates a driving signal to enable the alarm unit to output an alarm signal, and a notification message is sent to a remote communication device via the communication unit, wherein the movement of the lock cylinder moves along a sensing direction, the sensing direction is perpendicular to the inserting direction, and when the lock cylinder moves along the sensing direction, the sensing module generates the sensing signal to the processing unit, wherein the preset condition is when a duration of the sensing signal is equal to or longer than a preset time.

2. The lock according to claim 1, wherein when the unlocking unit inserts into a predetermined position of the lock cylinder, the unlocking unit is adapted to rotate around an axis which is perpendicular to the sensing direction.

3. The lock according to claim 2, wherein a distance is existed between the sensing module and the axis.

4. The lock according to claim 2, wherein the lock cylinder includes a protruding part and a cylinder part, the predetermined position is located in the cylinder part, the sensing module detects a movement of the protruding part along the sensing direction, and when the unlocking unit is inserted to the predetermined position, the cylinder part is adapted to rotate relative to the protruding part.

5. The lock according to claim 4, wherein the cylinder part includes an inserting hole for the unlocking unit, the unlocking unit inserts to the predetermined position through the inserting hole, and a distance between the sensing module and the axis is larger than that between an edge of the inserting hole and the axis.

6. The lock according to claim 2, wherein the sensing module includes a connecting wire and a switch, the connecting wire is electrically connected to the switch, the switch is disposed at a side of the sensing module near the axis, and when the lock cylinder presses the switch along the sensing direction, the sensing signal is sent through the switch and the connecting wire.

7. The lock according to claim 2, wherein the sensing module includes a sensing electrode and a lock cylinder electrode which is disposed on the lock cylinder, the lock cylinder electrode and the sensing electrode are electrically connected to the processing unit, and when the lock cylinder electrode contacts the sensing electrode, the sensing module generates the sensing signal.

8. The lock according to claim 1, the lock further comprising:

a record unit electrically connected to the processing unit to record the sensing signal received by the processing unit.

9. The lock according to claim 8, wherein the record unit records the duration and the frequency of the sensing signal received by the processing unit.

10. A lock comprising:

a lock cylinder adapted for allowing an unlocking unit to insert therein along an inserting direction;

at least one sensing module for detecting a movement of the lock cylinder;

a processing unit electrically connected to the at least one sensing module, wherein the sensing module generates a sensing signal to the processing unit according to the movement of the lock cylinder, and the processing unit determines whether the lock is normally unlocked according to the sensing signal;

an alarm unit connected to the processing unit; and a communication unit coupled to the processing unit, wherein when the sensing signal received by the processing unit meets a preset condition, the processing unit generates a driving signal to enable the alarm unit to output an alarm signal, and a notification message is sent to a remote communication device via the communication unit, wherein the movement of the lock cylinder moves along a sensing direction, the sensing direction is perpendicular to the inserting direction, and when the lock cylinder moves along the sensing direction, the sensing module generates the sensing signal to the processing unit, wherein the sensing signal meets the preset condition when a frequency of the sensing signal is equal to or greater than a preset frequency.

* * * * *